US005544762A

United States Patent [19]

Liimatainen et al.

[11] Patent Number: 5,544,762

[45] Date of Patent: Aug. 13, 1996

[54] SEPARATING APPARATUS

[75] Inventors: William J. Liimatainen, Monroe; Daniel R. Brauer, Beloit, both of Wis.

[73] Assignee: Knight Manufacturing Corp., Brodhead, Wis.

[21] Appl. No.: 297,311

[22] Filed: Aug. 26, 1994

[51] Int. Cl.[6] ..... B07B 13/05

[52] U.S. Cl. ..... 209/675; 209/260; 209/352; 209/393; 209/404; 209/408; 209/413

[58] Field of Search ..... 209/675, 677, 209/234, 288, 352, 393, 404, 405, 408, 409, 412, 413, 260, 259

[56] References Cited

U.S. PATENT DOCUMENTS 5,248,042 9/1993 Kuhmonen ..... 209/234

FOREIGN PATENT DOCUMENTS 2244941 12/1991 United Kingdom ..... 209/260

*Primary Examiner*—David H. Bollinger
*Attorney, Agent, or Firm*—David J. Archer

[57] ABSTRACT

A separating apparatus is disclosed for separating debris from materials. The apparatus includes a container which defines an opening for the flow therethrough of the materials. A frame is disposed adjacent to the opening. The frame has a first side which is pivotally connected to the container about a pivotal axis. A second side of the frame is disposed remote from the first side. A separating device is pivotally secured to the frame about a further pivotal axis. The separating device extends across the opening between the first and second side of the frame when in a first disposition thereof. An actuator co-operates with the separating device for permitting movement of the separating device to a second disposition thereof away from the frame and the opening. The arrangement is such that when the frame is pivoted away from a first location thereof to a second location thereof away from the opening, the separating device moves to the second disposition thereof away from the frame and the opening for ejecting the debris away from the frame.

16 Claims, 4 Drawing Sheets

SEPARATING APPARATUS

BACKGROUND OF THE INVENTION

1. Field of the Invention.

The present invention relates to a separating apparatus for separating debris from materials. More particularly, the present invention relates to a separating apparatus for ejecting debris while permitting the flow of materials.

2. Information Disclosure Statement.

Screening machines are machines which usually include a cylindrical screen mounted for rotation about a generally horizontal axis such that when materials are fed into the screening drum such materials are classified with finer materials being sifted through the rotary screen.

However, it is essential that an initial rough screening of irregular shaped objects and stringy material be carried out prior to feeding such materials into the rotary screening apparatus.

More particularly, often pieces of wire, string, branches and rocks are present in material to be sifted.

Typically, a grizzly bar arrangement is provided for catching and separating the aforementioned oversize materials.

The present invention provides a very simple and maintenance free arrangement for ejecting debris from a flow of materials.

Therefore, it is a primary objective of the present invention to provide a separating apparatus which overcomes the aforementioned inadequacies of the prior art arrangements and which makes a considerable contribution to the art of separating debris from materials.

Another object of the present invention is the provision of a separating apparatus which permits the ejection of debris away from an opening of a container.

Other objects and advantages of the present invention will be readily apparent to those skilled in the art by a consideration of the detailed description contained hereinafter taken in conjunction with the annexed drawings.

SUMMARY OF THE INVENTION

The present invention relates to a separating apparatus and method for separating debris from materials. The apparatus includes a container which defines an opening for the flow therethrough of the materials.

A frame is disposed adjacent to the opening. The frame has a first side which is pivotally connected to the container about a pivotal axis. The frame also includes a second side which is disposed remote from the first side.

Separating means is pivotally secured to the frame about a further pivotal axis. The separating means extends across the opening between the first and the second side of the frame.

An actuating means co-operates with the separating means for permitting movement of the separating means to a second disposition thereof away from the frame and the opening. The arrangement is such that when the frame is pivoted away from a first location thereof to a second location thereof away from the opening, the separating means moves to the second disposition thereof away from the frame and the opening for ejecting the debris away from the frame.

In a more specific embodiment of the present invention, the pivotal axis and the further pivotal axis are spaced and parallel relative to each other.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the drawings.

DETAILED DESCRIPTION OF THE DRAWINGS

Figure 1:
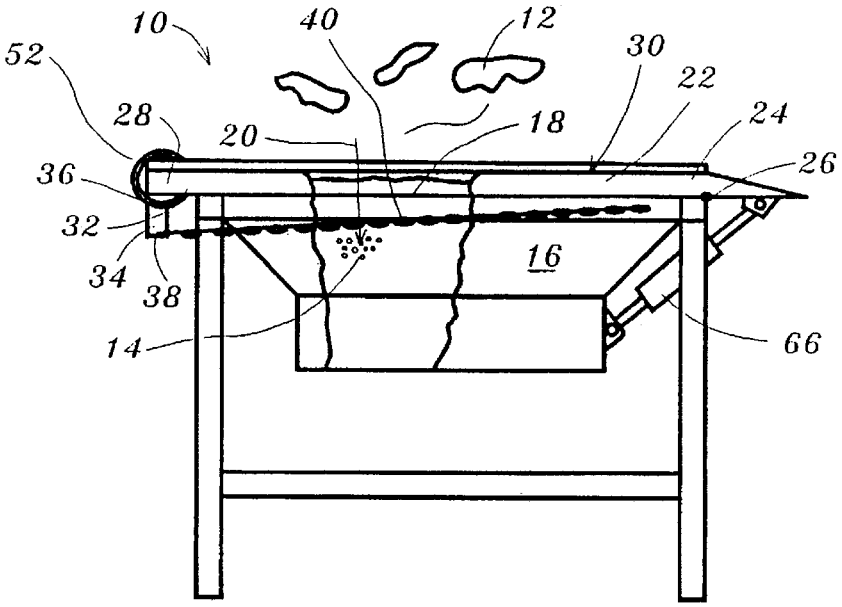
FIG. 1 is a side elevational view partially in section of a separating apparatus according to the present invention with the frame disposed in a first location thereof.

FIG. 1 is a side elevational view of a separating apparatus generally designated 10 for separating debris 12 from materials 14. The apparatus 10 includes a container 16 which defines an opening 18 for the flow therethrough as indicated by the arrow 20 of the materials 14.

A frame 22 is disposed adjacent to the opening 18. The frame 22 has a first side 24 which is pivotally connected to the container 16 about a pivotal axis 26. A second side 28 of the frame 22 is disposed remote from the first side 24.

Separating means generally designated 30 is pivotally secured to the frame 22 about a further pivotal axis 32. The separating means 30 extends across the opening 18 between the first and second side 24 and 28 respectively of the frame 22.

An arm 34 having a first and a second end 36 and 38 respectively is arranged such that the first end 36 is rigidly secured to the separating means 30. The second end 38 of the arm 34 extends away from the further pivotal axis 32.

An actuating means generally designated 40 such as a chain 41 extends from the second end 38 of the arm 34 to the container 16. The arrangement is such that when the frame 22 is pivoted away from the opening 18, as shown in FIGS. 2 and 3, the chain 41 pulls the second end 38 of the arm 34 so that the arm 34 and the separating means 30 pivot about the further axis 32 and the separating means 30 moves the debris 12 away from the opening 18.

More specifically, the container 16 is of rectangular configuration and the opening 18 is a rectangular shape.

Figure 2:
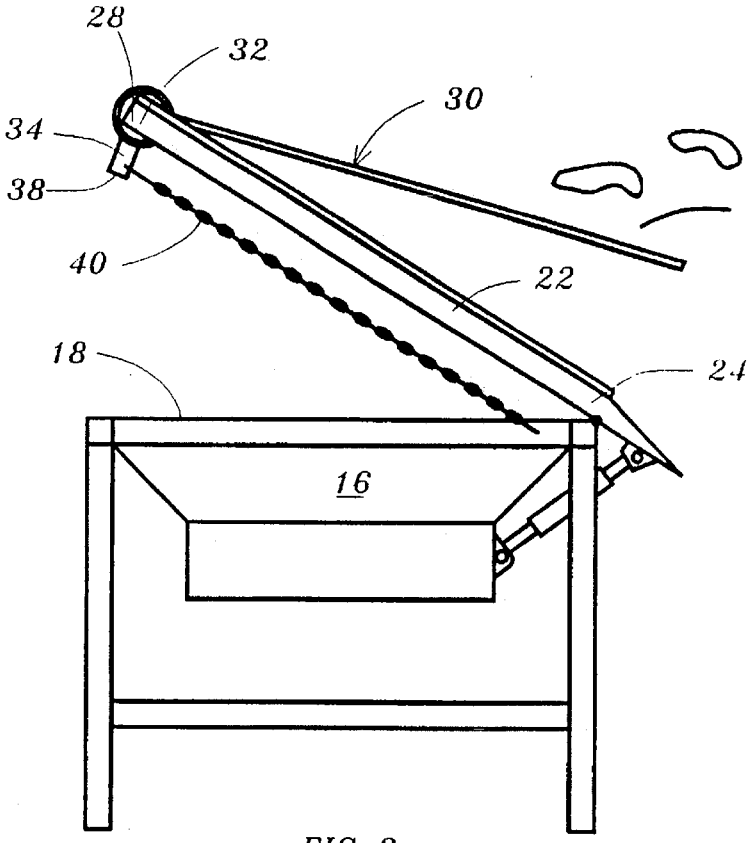
FIG. 2 is a similar view to that shown in FIG. 1 but shows the frame in a second location thereof with the second side of the frame having moved away from the opening.
Figure 3:
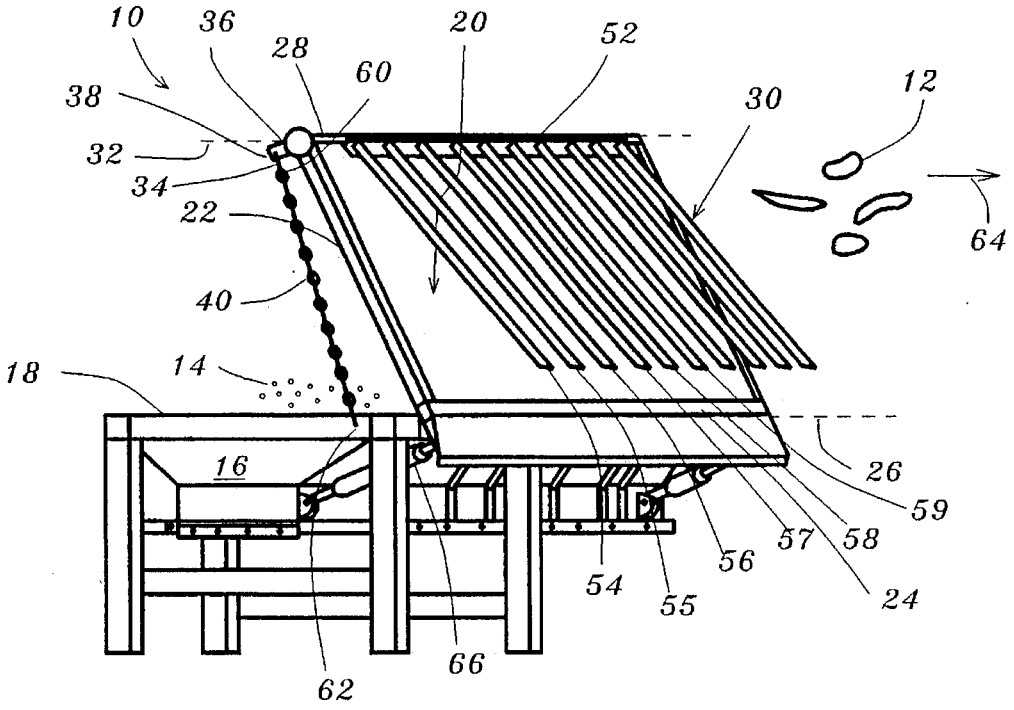
FIG. 3 is a perspective view of the separating apparatus with the separating means in the second disposition thereof.
Figure 4:
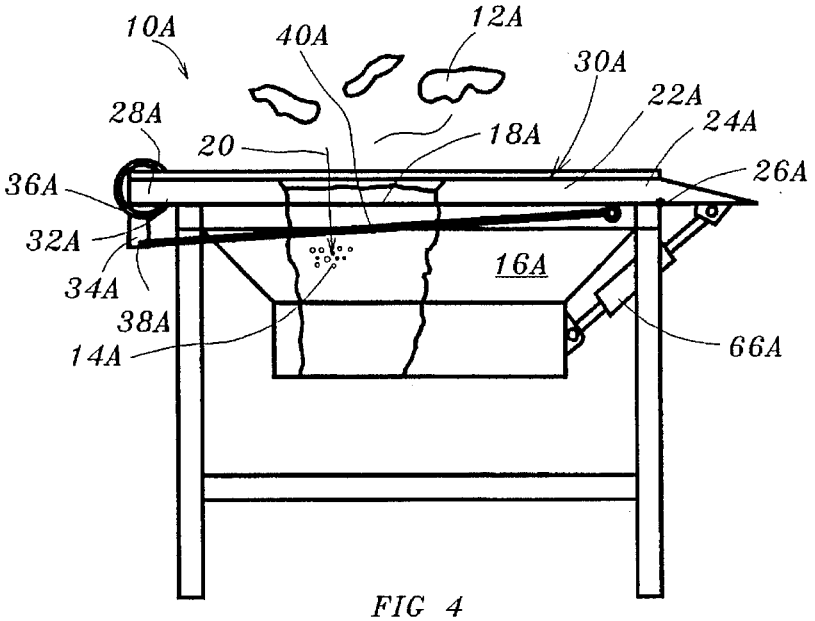
FIG. 4 is a similar view to that shown in FIG. 1 but shows the flexible means as a wire rope.

FIG. 4 shows an alternative embodiment of the present invention in which the separating apparatus 10A is identical with that shown in the embodiment of FIGS. 1–3, except in that the flexible means 41A is a wire rope.

Figure 5:
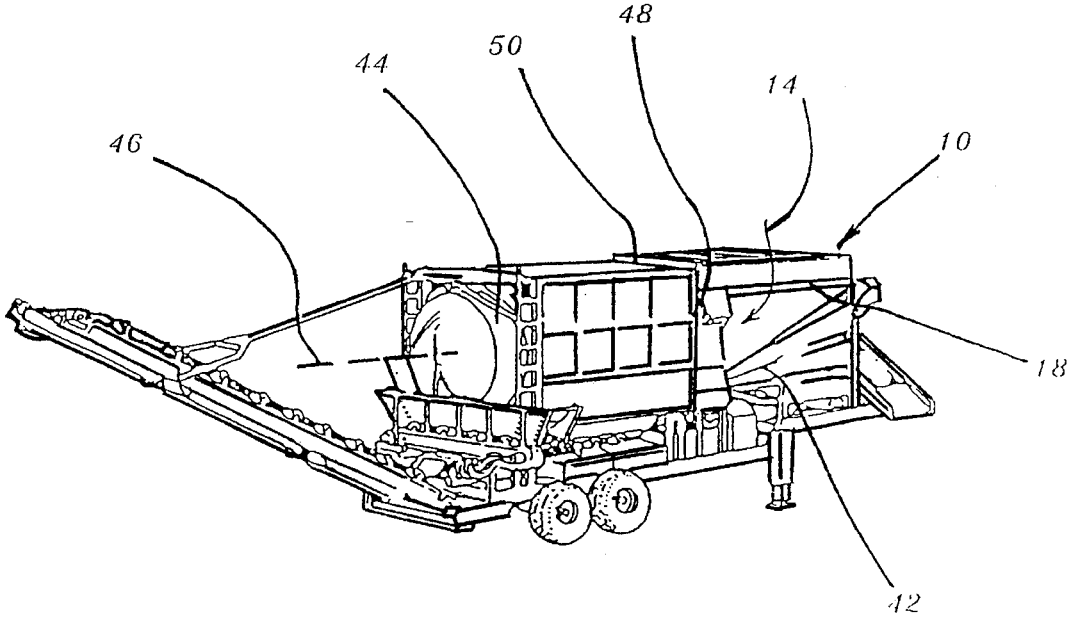
FIG. 5 is a perspective view of the apparatus shown in FIGS. 1–3 incorporated into a rotary screen machine.

FIG. 5 is a perspective view showing the separating apparatus 10 further including a chute 42 which extends from the opening 18 for guiding the materials 14 flowing through the opening 18.

A rotary screen 44 rotates about a substantially horizontal axis 46. The screen 44 defines a feed orifice 48 at one end 50 thereof for receiving the materials 14 guided by the chute 42 from the opening 18.

The frame 22 as shown in FIGS. 1–3 is of rectangular configuration and corresponds with the opening 18 of the container 16. The first side 24 of the frame 22 is pivotally secured to the container 16 about the pivotal axis 26. The frame 22 pivots from a first location thereof adjacent to the opening 18 as shown in FIG. 1 to a second location thereof as shown in FIGS. 2 and 3 in which the second side 28 of the frame 22 moves away from the opening 18 as shown in FIGS. 2 and 3. The frame 22 defines an angle of approximately 85 degrees with the container 16 when disposed in the second location thereof with the frame 22 fully moved away from the container 16.

The separating means 30 further includes a cross member 52 which is pivotally secured to the frame 22 about the further axis 32. The further axis 32 is disposed parallel to the pivotal axis 26.

A plurality of bars 54,55,56,57,58 and 59 are rigidly secured to and extend from the cross member 52 towards the first side 24 such that in a first disposition of the separating means 30 as shown in FIG. 1, the bars 54–59 rest on the first side 24 of the frame 22. In a second disposition of the separating means 30, as shown in FIGS. 2 and 3, the bars 54–59 move away from the first side 24 of the frame 22.

More specifically, the bars 54–59 are disposed spaced and parallel relative to each other for permitting the flow therethrough as indicated by the arrow 20 of the materials 14 while impeding the flow therethrough of debris 12 such as oversized solids, branches, stringy materials and the like.

In FIGS. 1–3, the pivotal axis 26 and the further pivotal axis 32 are spaced and parallel relative to each other.

Also, in a preferred embodiment of the present invention, the cross member 52 is of tubular configuration. The second side 28 of the frame 22 extends through the tubular cross member 52 such that the tubular cross member 52 rotates around the second side 28 of the frame 22.

The arm 34 extends away from the separating means 30 towards the opening 18 and the flexible means 41 is a chain.

More specifically, the flexible means 41 includes a first and a second extremity 60 and 62 respectively. The first extremity 60 is anchored to the second end 38 of the arm 34. The flexible means 41 extends to the container 16. The second extremity 62 of the flexible means 41 is anchored to the container 16 such that when the second side 28 is moved away from the container 16 as shown in FIGS. 2 and 3, the flexible means 41 pulls the second end 38 of the arm 34 towards the first side 24 of the frame 22 so that the separating means 30 moves away from the frame 22 to the second disposition thereof for ejecting the debris 12 away from the opening 18 as indicated by the arrow 64.

In operation of the apparatus 10, debris 12 and materials 14 are fed onto the top of the separating means 30 so that the flowable material 14 flow as indicated by the arrow 20 through and between adjacent bars 54–59 into the opening 18 and the container 16. At the same time, stringy material, oversized rocks, branches and the like 12 remain and are separated by the plurality of bars 54–59.

Periodically, the frame 22 is moved upwardly relative to the opening as for example by means of a hydraulic actuating device 66. However, as the second side 28 of the frame 22 is moved upwards away from the opening 18, the chain 40 which is anchored at 62 to the container 16 and to the second end 38 of the arm 34, will pull the second end 38 of the arm 34 towards the first side 24 of the frame 22. The arrangement is such that the cross member 52 and the bars 54–59 are moved upwardly away from the frame 22 so that debris 12 resting on the bars 54–59 is ejected away from the opening as indicated by arrow 64 thereby clearing the bars 54–59 of the accumulated debris 12.

Figure 6:
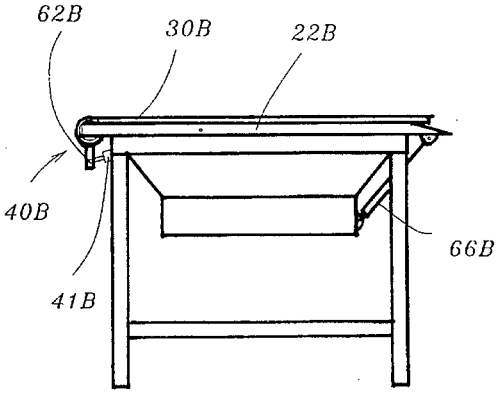
FIG. 6 is a side elevational view of a separating apparatus according to a further embodiment of the present invention.
Figure 7:
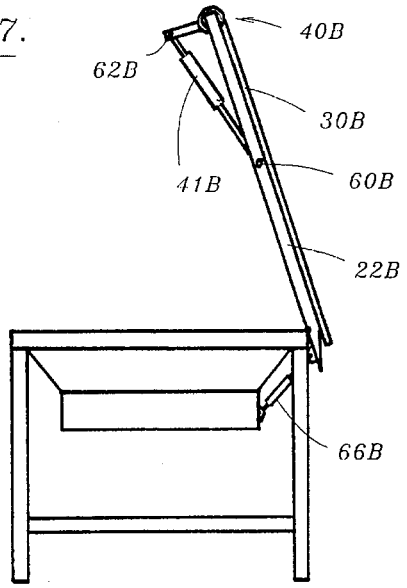
FIG. 7. is a side elevational view of the separating apparatus shown in FIG. 6. with the frame disposed in the second location thereof.
Figure 8:
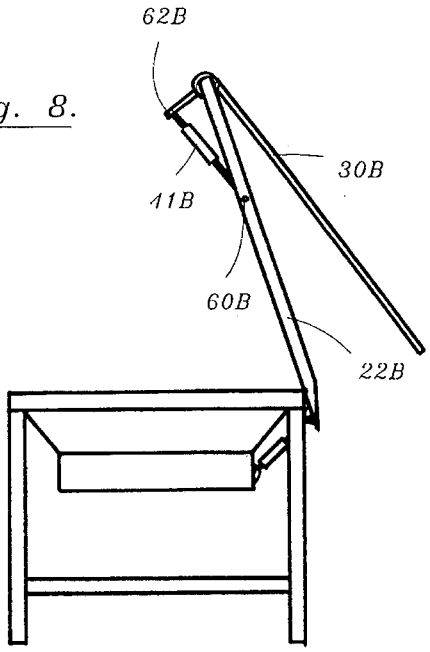
FIG. 8. is a similar view to that shown in FIG. 7 but shows the separating means in a second disposition thereof.

FIGS. 6 to 8 are side elevational views of an alternative embodiment of the present invention.

The embodiment of FIGS. 6–8 is the same as that shown in FIGS. 1–3 except in that the actuating means generally designated 40B includes a cylinder such as a hydraulic, pneumatic or electrically operated cylinder 41B having a first and a second extremity 60B and 62B respectively.

The first extremity 60B is pivotally secured to the frame 22B and the second extremity 62B is pivotally secured to the separating means 30B such that when the cylinder 41B is actuated, the separating means 30B is pivoted from the first disposition of the separating means 30B as shown in FIG. 6 to the second disposition thereof as shown in FIG. 8, with the separating means 30B having moved away from the frame 22B for ejecting the debris.

FIG. 7 shows an actuating device 66B having moved the frame 22B from the first location thereof as shown in FIG. 6 to the second location thereof as shown in FIG. 7 but with the separating means 30B still in the first disposition thereof relative to the frame 22B. Subsequently, on actuation of the actuating means 40B, the cylinder 41B moves the separating means 30B away from the frame 22B to the second disposition thereof as shown in FIG. 8.

Figure 9:
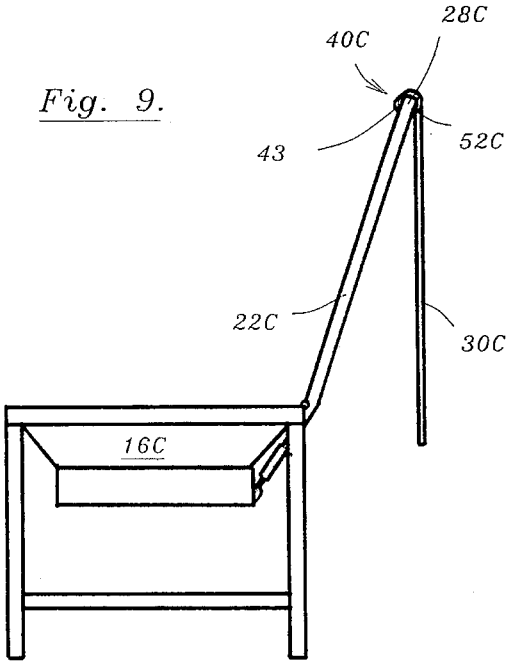
FIG. 9. is a side elevational view of a separating apparatus according to yet another embodiment of the present invention.

FIG. 9 is a side elevational view of yet another embodiment of the present invention which is similar to the embodiment shown in FIGS. 6–8 with the exception that the actuating means generally designated 40C includes a hinge 43 which has a tubular member 52C through which the second side 28C of the frame 22C extends.

Accordingly, when the frame 22C is moved to the second location thereof as shown in FIG. 9, so that the frame 22C defines an angle of more than 90 degrees relative to the container 16C, the weight of the separating means 30C causes the separating means 30C to hinge outwardly away from the frame 22C under the influence of gravity to the second disposition thereof as shown in FIG. 9.

In the second disposition of the separating means 30C as shown in FIG. 9. debris is ejected from the separating means 30C.

The present invention provides a relatively simple means for ejecting debris away from materials being fed into a rotary screening apparatus.

What is claimed is:

1. A separating apparatus for separating debris from materials, said apparatus comprising:

a container having an opening for the flow therethrough of the materials;

a frame having a first side pivotally connected to said container about a pivotal axis and a second side disposed remote from said first side, said frame being disposed adjacent to said opening when said frame is in a first location thereof:

separating means pivotally secured to said frame about a further pivotal axis, said separating means extending across said opening between said first and second side of said frame when said separating means is in a first disposition thereof;

actuating means being secured to said separating means for permitting movement of said separating means to a second disposition thereof away from said frame and said opening, such that when said frame is pivoted away from said first location thereof away from said opening to a second location thereof, said separating means moves to said second disposition thereof away from said frame and said opening for ejecting the debris away from said frame;

said actuating means including:

an arm having a first and second end, said first end being rigidly secured to said separating means, said second end extending away from said further pivotal axis towards said opening; and flexible means extending from said second end of said arm to said container, the arrangement being such that when said frame is pivoted away from said opening, said flexible means pulls said second end of said arm so that said arm and separating means pivot about said further axis, said separating means moving away from said frame and said opening for ejecting the debris away from said opening.

2. A separating apparatus as set forth in claim 1 wherein said container is of rectangular configuration and said opening is of rectangular shape.

3. A separating apparatus as set forth in claim 1 further including:

a chute extending from said opening for guiding the materials flowing through said opening;

a rotary screen rotating about a substantially horizontal axis, said screen defining an orifice at one end thereof for receiving materials guided by said chute from said opening.

4. A separating apparatus as set forth in claim 1 wherein said frame is of rectangular configuration corresponding with said opening of said container, said first side of said frame being pivotally secured to said container about said pivotal axis, said frame pivoting from said first location thereof adjacent to said opening to said second location thereof in which said second side of said frame moves away from said opening.

5. A separating apparatus as set forth in claim 1 wherein said separating means further includes:

a cross member pivotally secured to said frame about said further pivotal axis, said further axis being disposed parallel to said pivotal axis;

a plurality of bars rigidly secured to and extending from said cross member towards said first side of said frame such that when said separating means is in said first disposition thereof, said bars rest on said first side of said frame and when said separating means is in said second disposition thereof, said bars move away from said first side of said frame.

6. A separating apparatus as set forth in claim 5 wherein said bars are disposed spaced and parallel relative to each other for permitting the flow therethrough of the materials while impeding the flow therethrough of debris, oversized solids, branches, stringy materials and the like.

7. A separating apparatus as set forth in claim 1 wherein said pivotal and further pivotal axes are spaced and parallel relative to each other.

8. A separating apparatus as set forth in claim 7 wherein said separating means further includes:

a cross member pivotally secured about said further pivotal axis;

a plurality of bars rigidly secured to and extending from said cross member towards said first side of said frame such that when said separating means is in said first disposition thereof, said bars rest on said first side of said frame and when said separating means is in said second disposition thereof, said bars move away from said first side of said frame;

said cross member being of tubular configuration, said second side of said frame extending through said tubular cross member such that said tubular cross member rotates around said second side of said frame.

9. A separating apparatus as set forth in claim 1 wherein said flexible means is a chain.

10. A separating apparatus as set forth in claim 1 wherein said flexible means is a wire rope.

11. A separating apparatus as set forth in claim 1 wherein said flexible means includes:

a first and a second extremity, said first extremity being anchored to said second end of said arm, said second extremity being anchored to said container such that when said second side is moved away from said container, said flexible means pulls said second end of said arm towards said first side of said frame so that said separating means moves away from said frame to said second disposition thereof for ejecting debris away from said opening.

12. A separating apparatus as set forth in claim 1 wherein said actuating means includes:

a cylinder having a first and second extremity, said first extremity being pivotally secured to said frame, said second extremity being pivotally connected to said separating means such that when said cylinder is actuated, said separating means is pivoted to said second disposition thereof for ejecting the debris.

13. A separating apparatus as set forth in claim 12 wherein said cylinder is a hydraulic cylinder.

14. A separating apparatus as set forth in claim 12 wherein said cylinder is a pneumatic cylinder.

15. A separating apparatus as set forth in claim 12 wherein said cylinder is an electrically operated cylinder.

16. A separating apparatus for separating debris from materials, said apparatus comprising:

a container having an opening for the flow therethrough of the materials:

a frame having a first side pivotally connected to said container about a pivotal axis and a second side disposed remote from said first side, said frame being disposed adjacent to said opening when said frame is in a first location thereof;

separating means pivotally secured to said frame about a further pivotal axis, said separating means extending across said opening between said first and second side of said frame when said separating means is in a first disposition thereof;

actuating means being secured to said separating means for permitting movement of said separating means to a second disposition thereof away from said frame and said opening, such that when said frame is pivoted away from said first location thereof away from said opening to a second location thereof, said separating means moves to said second disposition thereof away from said frame and said opening for ejecting the debris away from said frame;

said actuating means including:

a hinge for pivotally connecting said separating means to said second side of said frame such that when said frame is disposed in said second location thereof, the weight of said separating means hinges said separating means by gravity away from said frame towards a second disposition of said separating means for ejecting the debris.

* * * * *